US005080326A

United States Patent [19]

Price et al.

[11] Patent Number: 5,080,326

[45] Date of Patent: Jan. 14, 1992

[54] METHOD AND APPARATUS FOR REFINING THE DOMAIN STRUCTURE OF ELECTRICAL STEELS BY LOCAL HOT DEFORMATION AND PRODUCT THEREOF

[75] Inventors: Leroy R. Price, Allison Park; Jeffrey M. Breznak, New Kensington, both of Pa.

[73] Assignee: Allegheny Ludlum Corporation, Pittsburgh, Pa.

[21] Appl. No.: 637,590

[22] Filed: Jan. 4, 1991

Related U.S. Application Data

[62] Division of Ser. No. 382,169, Jul. 19, 1989.

[51] Int. Cl.[5] ..... C21D 9/54

[52] U.S. Cl. ..... 266/103; 148/104; 148/108; 148/110; 72/197; 72/364

[58] Field of Search ..... 266/103, 104, 108, 110; 72/197, 364

[56] References Cited

U.S. PATENT DOCUMENTS 4,711,113 12/1987 Benford ..... 72/197
4,742,706 5/1988 Sasaki et al. ..... 72/197

FOREIGN PATENT DOCUMENTS 61-106717 5/1986 Japan ..... 72/197

*Primary Examiner*—John P. Sheehan
*Attorney, Agent, or Firm*—Patrick J. Viccaro

[57] ABSTRACT

A method is provided for improving the electrical characteristics of grain-oriented silicon steel sheet by heating the steel to temperatures above 1000° F. and then deforming grooves to refine the magnetic domains, optionally, post heat treating to form fine recrystallized grains in the vicinity of the hot deformations, preferably using protrusions on a scribing roll as the sheet moves between a scribing roll and a back-up anvil roll at deforming pressures range up to 120,000 pounds per square inch.

5 Claims, 5 Drawing Sheets

METHOD AND APPARATUS FOR REFINING THE DOMAIN STRUCTURE OF ELECTRICAL STEELS BY LOCAL HOT DEFORMATION AND PRODUCT THEREOF

BACKGROUND OF THE INVENTION

This invention relates to a method and apparatus for improving core loss by refining the magnetic domain wall spacing of electrical sheet or strip products. More particularly, this invention relates to method of processing final texture annealed grain-oriented silicon steels to permanently refine the domain structure using local hot deformation.

Grain-oriented silicon steel is conventionally used in electrical applications, such as power transformers, distribution transformers, generators, and the like. The steel's ability to permit cyclic reversals of the applied magnetic field with only limited energy loss is a most important property. Reductions of this loss, which is termed "core loss", is desirable.

In the manufacture of grain-oriented silicon steel, it is known that the Goss secondary recrystallization texture, (110)[001] in terms of Miller's indices, results in improved magnetic properties, particularly permeability and core loss over non-oriented silicon steels. The Goss texture refers to the body-centered cubic lattice comprising the grain or crystal being oriented in the cube-on-edge position. The texture or grain orientation of this type has a cube edge parallel to the rolling direction and in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt having on the order of 2–4.5% silicon, casting the melt, hot rolling, cold rolling the steel to final gauge typically of 7 or 9 mils, and up to 14 mils with intermediate annealing when two more cold rollings are used, decarburizing the steel, applying a refractory oxide base coating, such as a magnesium oxide coating, to the steel, and final texture annealing the steel at elevated temperatures in order to produce the desired secondary recrystallization and purification treatment to remove impurities such as nitrogen and sulfur. The development of the cube-on-edge orientation is dependent upon the mechanism of secondary recrystallization wherein, during recrystallization, secondary cube-on-edge oriented grains are preferentially grown at the expense of primary grains having a different and undesirable orientation.

As used herein, "sheet" and "strip" are used interchangeably and mean the same unless otherwise specified.

It is also known that through the efforts of many prior art workers, cube-on-edge grain-oriented silicon steels generally fall into two basic categories: first, regular or conventional grain-oriented silicon steel, and second, high permeability grain-oriented silicon steel. Regular grain-oriented silicon steel is generally characterized by permeabilities of less than 1870 at 10 Oersteds. High permeability grain-oriented silicon steels are characterized by higher permeabilities which may be the result of composition changes alone or together with process changes. For example, high permeability silicon steels may contain nitrides, sulfides, and/or borides which contribute to the particles of the inhibition system which is essential to the secondary recrystallization process for the steel. Furthermore, such high permeability silicon steels generally undergo heavier cold reduction to final gauge than regular grain oriented steels; a final heavy cold reduction on the order of greater than 80% is made in order to facilitate the high permeability grain orientation. While such higher permeability materials are desirable, such materials tend to produce larger magnetic domains than conventional material. Generally, larger domains are detrimental to core loss.

It is known that one of the ways that domain size and thereby core loss values of electrical steels may be reduced is if the steel is subjected to any one of various practices designed to induce localized strains in the surface of the steel. Such practices may be generally referred to as "domain refining by scribing" and are performed after the final high temperature annealing operation. If the steel is scribed after the final texture annealing, then there is induced a localized stress state in the texture-annealed sheet so that the domain wall spacing is reduced. These disturbances typically are relatively narrow, straight line patterns, or scribes, generally spaced at regular intervals. The scribe lines are substantially transverse to the rolling direction and typically are applied to only one side of the steel.

In fabricating electrical steels into transformers, the steel inevitably suffers some deterioration in core loss quality due to cutting, bending, and construction of cores during fabrication, all of which impart undesirable stresses in the material. During fabrication incident to the production of stacked core transformers and, more particularly, power transformers in the United States, the deterioration in core loss quality due to fabrication is not so severe that a stress relief anneal (SRA), typically about 1475° F. (801° C.), is essential to restore properties. For such end uses there is a need for a flat, domain-refined silicon steel which need not be subjected to stress relief annealing. In other words, the scribed steel used for this purpose does not have to possess domain refinement which is heat resistant.

However, during the fabrication incident to the production of most distribution transformers in the United States, the steel strip is cut and subjected to various bending and shaping operations which produce more working stresses in the steel than in the case of power transformers. In such instances, it is necessary and conventional for manufacturers to stress relief anneal (SRA) the product to relieve such stresses. During stress relief annealing, it has been found that the beneficial effect on core loss resulting from some scribing techniques, such as mechanical and thermal scribing, are lost. For such end uses, it is required and desired that the product exhibit heat resistant domain refinement (HRDR) in order to retain the improvements in core loss values resulting from scribing.

In referring now to certain prior teaching, U.S. Pat. Nos. 4,533,409, issued Dec. 19, 1984 and U.S. Pat. No. 4,711,113, issued Dec. 8, 1987 disclose a method and apparatus for scribing a grain-oriented silicon steel to refine the grain structure by passing the cold strip through a roll pass defined by an anvil roll and scribing roll having a surface with a plurality of projections extending along the roll axis. The anvil roll is typically constructed from a material that is relatively more elastic than the material from which the scribing roll is constructed. Preferably, the scribing roll is constructed from steel and the anvil roll is constructed from rubber. The process described in U.S. Pat. No. 4,711,113, maybe performed prior to or after final texture annealing but the domain refinement achieved is not maintained through the usual stress relief annealing temperatures.

U.S. Pat. No. 4,742,706, issued May 10, 1988 discloses an apparatus for imparting strain to a moving steel sheet at linear spaced apart deformed regions. The apparatus includes a strain imparting roll having a plurality of projections as in the above described U.S. Pat. No. 4,711,113. The apparatus of the '706 patent also includes a press roll, a plurality of back-up rolls and fluid pressure cylinder interconnected so as to control pressure against the press roll.

U.S. Pat. No. 4,770,720, issued Sept. 13, 1988 discloses cold deformation technique wherein final texture annealed grain oriented silicon steel at as low as room temperature, preferably 50° to 500° C. (122° to 932° F.) is subjected to local loading, at a mean load of 90 to 220 kg/mm$^2$ to (127,000 to 325,000 PSI) to form spaced apart grooves. The sheet must then be annealed at 750° C. (1380° F.) or more so that fine recrystallized grains are formed to divide the magnetic domains and improve core loss values which survive subsequent stress relief annealing.

The present invention provides a new method characterized by low cost scribing practice compatible with conventional steps and equipment for producing grain-oriented silicon steels. Furthermore, the method applies a uniform scribing operation in a continuous processing line in a relatively uncomplicated manner.

SUMMARY OF THE PRESENT INVENTION

In accordance with the present invention, a method and apparatus are provided for refining the domain wall spacing of a grain oriented silicon steel sheet and the product thereof, which comprises the steps of (1) heating the steel sheet to a temperature, preferably in the range of 1000° F. to 1400° F. (540° C. to 760° C.), (2) thereafter producing localized hot deformation to facilitate development of localized fine recrystallized grains in the vicinity of the areas of localized deformations to effect heat resistant domain refinement and core loss.

Preferably, the localized hot deformation is produced in silicon steel in a form of a continuous strip and is achieved by moving the strip between pay-off and take-up reels, and between the first and second reels passing the strip between a scribing roll and a back-up anvil roll. The scribing roll is provided with a pattern of predetermined plurality of protrusions spaced around its circumference and separated by grooves extending substantially along the axis of the scribing roll whereby the scribing roll contacts the strip along spaced apart line pattern areas.

The above and other objects and features of the invention will become apparent from the following detailed description taken in connection with the accompanied drawings which form a part of this specification and in which:

DETAILED DESCRIPTION OF THE INVENTION

Figure 1A:
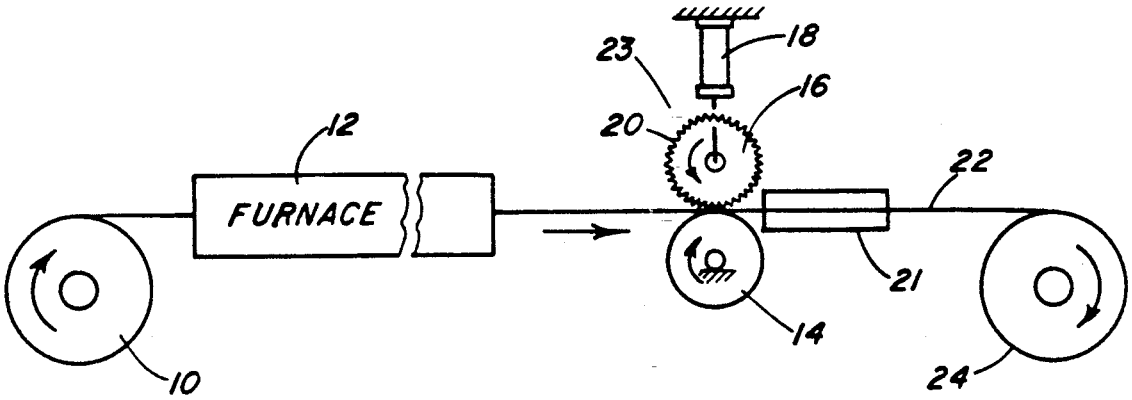
FIG. 1A is a schematic illustration of one type of method and apparatus which can be used to commercially produce steels in accordance with the invention.

Broadly, in accordance with the method, apparatus and product of the invention, silicon steel strip having a silicon content of the order of 2 to 4.5%, after development of the desired grain orientation, is passed between an anvil roll means and a scribing roll means to deform the steel at elevated temperature in a predetermined scribing pattern to effect domain refinement. The apparatus used to carry out the method and produce the product may take various forms, for example, the scribing means may include an impact hammer having a knife-like edge for hitting and deforming the steel in parallel line patterns. As shown in FIG. 1A, in accordance with the preferred form of the invention, a silicon steel strip 22, after development of the desired grain orientation, is passed through a roll pass or set 23 defined by an anvil roll 14 and a scribing roll 16 having a plurality of projections 20 thereon.

The silicon steel strip useful in the present invention is final texture annealed grain oriented silicon steel having an insulative coating thereon. The particular compositions of the steel are not critical to the present invention. The high permeability steel mentioned herein had initial melts of the following nominal composition:

| C | N | Mn | S | Si | Cu | B | Fe |
|---|---|---|---|---|---|---|---|
| .030 | <50 ppm | .038 | .017 | 3.15 | .30 | 10 ppm | Balance |

As used herein, the term "line pattern" and synonymous terms refer to a continuous line or a discontinuous line such as an array of dots, dashes, or combinations thereof.

The anvil roll 14 may be constructed of any of various materials such as customarily employed in the art of reduction and processing of steel strip, to provide a sufficiently strong back-up anvil surface which contacts one side of the steel. Preferably, anvil roll 14 is relatively smooth throughout its circumference.

The roll set 23 may be generally freely-rotatable rolls which are caused to rotate about their axes by the pinching contact with the moving strip 22 passing therebetween, but if desired either the anvil or the scribing means may be driven. It is preferred that the rolls be rotated at a tangential velocity essentially equal to the velocity of strip 22 passing through the roll set 23.

Scribing roll 16, which may be one or more rolls, preferably has a roll surface with a plurality of projections 20 thereon in an equal spaced apart relation, such as generally disclosed in the above-mentioned U.S. Pat. No. 4,711,113, assigned to the common assignee here. The scribing roll may constructed of various materials, such as metals or ceramics which are relatively inelastic, i.e. hard and durable enough to withstand the compressive impact and/or contact with strip 22 at elevated temperature as it passes through roll set 23. Projections or protrusions 20 are generally arranged on the roll surface in a direction substantially parallel to the axes of rolls 14 and 16. Preferably, projections 20 extend in a helical or spiral pattern about the roll axis on the roll surface.

Figure 1B:
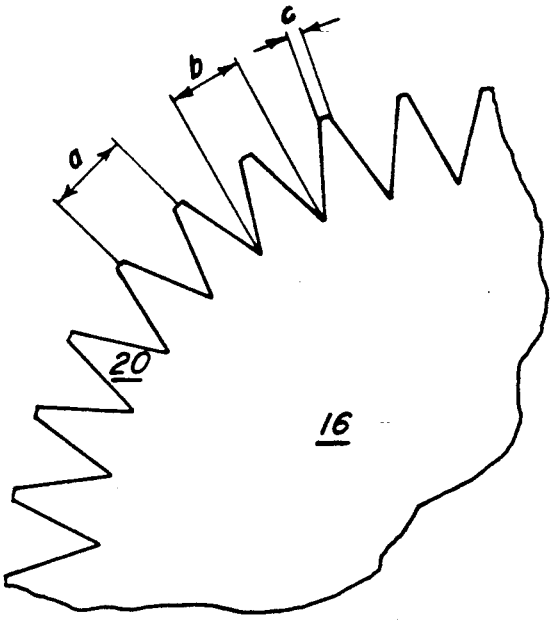
FIG. 1B is an illustration of the projections of the scribing roll of the present invention.

Projections or protrusions 20 may be of any of various shapes, preferably in a general triangular shape i.e. tooth shape (cross section) in order to narrowly define the area of compressive force or stress applied to the surface of strip 22. The projections 20 may be sharp, rounded or flat tipped, for example. In a given case, the particular dimensions of the spacing, size, depth and width of the projections 20 may vary, although they are important to achieve the desired magnetic improvements in the steel. The resulting grooves or deformations in the steel may form continuous or discontinuous line patterns extending across the strip width. As better shown in FIG. 1B, projections 20 are spaced apart near the peaks a distance "a" on the order of 2 to 10 mm. The width "b" of each projection as measured between the valleys defining a projection may be on the order of 2 to 10 mm. The depth of the grooves or deformations in the strip useful for processing the heated condition of the strip, 22, may range from 0.0001 to 0.002 inch (0.0025 to 0.051 mm). In a given case, the dimension of the flat "c" of the projections maybe 0.0005 inch to 0.003 inch (0.013 to 0.076 mm).

A commercially useful embodiment of the invention will process silicon steel in the form of a continuous strip moving between pay-off and take-up reels. After issuing from the payoff reel, the steel would pass through a heating furnace and then pass between the scribing and back-up or anvil rolls. Sufficient tension applied by the take-up reel on the strip may be used to pull the strip through the scribing unit as long as it does not exceed the yield strength of the hot strip.

In again referring to FIG. 1, which illustrates a typical embodiment of the invention, there is included a pay-off reel 10 and a furnace 12. After passing through furnace 12, the strip is at an elevated temperature, preferably about 1000° F. to 1800° F. (538° C. to 982° C.). It then passes between a back-up or anvil roll 14 and an upper scribing roll 16 which, for example, can be loaded by means of screw-downs or hydraulic cylinders 18. Scribing roll 16 is provided on its circumference with spaced grooves separated by projections 20 as described above. After passing between the rolls 14 and 16, the steel strip 22 is wound upon a take-up reel 24. In one embodiment, a housing means or insulating means 21 may be used immediately after the roll set 23 to maintain the strip temperature elevated to facilitate development of the primary or fine recrystallized grains. By maintaining the elevated temperature for a sufficient time after the hot deformation, the strip will develop primary recrystallized grains and exhibit improved magnetic properties. This was particularly found when the strip was heated and maintained at temperatures above about 1400° F. (760° C.). When the strip is heated between about 1000° to 1800° F. (540° to 980° C.), passed through the rollset 23 and allowed to cool below the hot deformation temperature, then the primary recrystallized grains do not satisfactorily develop. A post heat treatment is necessary to develop the primary recrystalization beneath the lines of deformation in the strip. The post heat treatment temperature may be on the order of between 1200° to 2000° F. (649° to 1093° C.), for a relatively short time, for example, a few minutes. Preferably, the conventional stress relief anneal (SRA) temperatures on the order of 1450° F. (788° C.) will suffice for the post heat treatment.

In order to achieve the desirable results of the present invention, the strain rate or deformation rate of the silicon steel must be sufficient to facilitate development of the fine recrystallized grains. To achieve this objective the steel temperature and speed of deformation and deformation pressure must be controlled to produce a strain rate sufficient to facilitate development of localized fine recrystallized grains. In carrying out the invention, the silicon steel sheet, after development of the cube-on-edge orientation, is initially heated to a temperature, preferably about 1000° F. to 1800° F. (538° C. to 980° C.) and more preferably about 1100° F. to 1500° F. (593° C. to 816° C.). At such temperatures, the steel is strain rate sensitive whereas colder steel such as below about 1000° F. (538° C.) are less sensitive. The colder the steel, the progressively less strain sensitive it becomes. The strain rates achieved by line speeds, roll tangential speeds, of greater than 50 feet per minute are acceptable. The proper combination of temperature and load or pressure on the steel sheet workpiece and the line speed will result in a sufficient strain rate.

The pressure exerted by the projections 20 of scribing roll 16 may range up to about 120,000 pounds per square inch (PSI), preferably up to about 100,000 PSI and typically may range from 15,000 to 100,000 PSI. The pressure should not substantially exceed 120,000 PSI because higher pressures will result in strip breakage at these elevated temperatures. The pressure or load is proportional to the roll gap setting of the roll set 23. The actual load or pressure to use is dependent upon the actual strip temperature during hot deformation.

The strip speeds through the roll set must be sufficiently fast to contribute to the necessary strain rate and may range up to 300 feet per minute (92 meters/minute) which is a compatible processing line speed for silicon steel. The speed should not go below approximately 20 feet/minute (6 meters/minute) which has shown to provide inadequate strain rates and preferably range from 50 to 200 feet/minute (15 to 61 meters/minute).

The desirable results achieved with the invention are illustrated by the following examples:

Initial trials of the idea of localized hot deformation and recrystallization to effect a heat resistant domain refinement (HRDR), were conducted on a small laboratory rolling mill. A nearby furnace was used to heat silicon steel samples in air to temperatures in the 1500° F. to 1650° F. (816° C. to 899° C.) range prior to the hot deformation. Since there was a loss of temperature in the interval between removing the samples from the furnace and the actual deformation on the rolling mill, the sample temperatures fell into the 1200° F. to 1400° F. (649° C. to 700° C.) range between the deforming and anvil rolls. The rolling mill was fitted with a five-inch diameter bottom roll with a five-inch working face and a smooth circumferential surface. This roll is referred to as the anvil roll in the context of work done in the experiments. The top roll was of similar dimensions but was machined to the geometry of a helical gear. The gear teeth pitch was 5 millimeters and had flat tips about 0.25 mm wide. The helical angle of the gear teeth with respect to the axis of the roll was 15°. The top roll comprises the deforming roll or hot mashing roll.

In order to better understand the present invention, the following examples are presented.

EXAMPLE I

Samples of a high-permeability grain oriented silicon steel such as described above and having permeability at 10 Oersteds ($\mu 10$) levels in excess of 1880, 30 mm wide by 305 mm long, were heated in the furnace to 1500° F. (816° C.) before running them through the rolling mill at a linear speed of 20 feet per minute (6 meters/minute). Visual observation of the strips entering the rolls indicated a temperature of about 1200° F. (649° C.). Following the scribing deformation treatment, the samples were given a four-hour anneal at 1450° F. (788° C.) in a protective atmosphere of 85% nitrogen-15% hydrogen. The anneal was necessary to remove curvature induced in the samples by the deformation, and to allow testing for the magnetic properties. The following Table I illustrates the results achieved with the samples:

TABLE I

Magnetic Properties Before and After Hot Deformation (Scribing at 1200° F. (688° C.) and 20 Feet Per Minute)

| | Before Scribing | | | | After Scribing | | |
|---|---|---|---|---|---|---|---|
| Sample | μ10 | P1.5 (mwpp) | P1.7 (mwpp) | Gage (mils) | μ10 | P1.5 | P1.7 |
| 25 | 1899 | 421 | 610 | 8.48 | 1867 | 425 | 636 |
| 28 | 1930 | 443 | 617 | 8.49 | 1888 | 425 | 598 |
| 30 | 1874 | 480 | 689 | 8.70 | 1860 | 432 | 642 |
| 32 | 1910 | 448 | 636 | 8.35 | 1861 | 432 | 628 |
| 34 | 1907 | 442 | 639 | 8.45 | 1865 | 416 | 620 |
| 35 | 1893 | 447 | 638 | 8.71 | 1839 | 531 | 751 |

This initial trial made it clear that core loss reductions could be achieved by localized hot deformation since four of the six samples experienced reductions in core loss at 1.5 T (P1.5) at 60 Hertz ranging from 3 to 10 percent. Core loss was measured and reported here as milliwatts per pound (mwpp). It was also apparent that the desirable magnetic properties of samples could be made worse as a result of too severe a hot deformation. This is made clear by Sample 35 which presumably, because of its heavier gage, experienced too much deformation in the preset roll gap as evidenced by the decline of its μ10 level from 1893 to a very low 1839. Metallographic observation of cross sections of the steel after a 1450° F. (788° C.) anneal revealed occasional primary grains in the secondary grain structure beneath the lines of localized hot deformation.

EXAMPLE II

In this trial, the furnace temperature was set at 1650° F. (988° C.) for steel samples of the composition of Example I. Some actual measurements of delivery temperatures were made by attaching thermocouples to dummy strips, heating them in the furnace and then delivering them to the roll bite where temperatures were found to be about 1400° F. (760° C.) at the beginning of the sample's passage through the rolls and 1300° F. (704° C.) at the end. For this trial, the gap between the anvil roll and the scribing roll was initially set to provide a very slight amount of deformation and then the roll gap was reduced in small increments to provide greater deformation as the trials proceeded. The increments were in progressive equal movements of the screw-down used to adjust the roll gap. The exact change in roll gap at each increment was not known except that it was on the order of fractions of a thousandth of an inch. The increments in the table that follows are labeled Max, Max-1, Max2, etc. Following the deformations, the samples were thereafter annealed as described above to remove the induced curvature prior to magnetic testing.

TABLE II

Magnetic Properties Before and After Hot Deformation (Scribing at 1400° F. (760°) and 20 Feet Per Minute)

| Before Scribing | | | | After Scribing | | | |
|---|---|---|---|---|---|---|---|
| μ10 | P1.5 (mwpp) | Gage (mils) | Roll Gap | μ10 | P1.5 (mwpp) | μ10 Δ | P1.5Δ (mwpp) |
| 1924 | 421 | 8.64 | Maximum | 1905 | 402 | −19 | −19 |
| 1905 | 424 | 8.65 | Maximum | 1896 | 442 | −9 | +18 |
| 1905 | 460 | 8.72 | Maximum | 1887 | 431 | −18 | −29 |
| 1900 | 412 | 8.81 | Maximum | 1877 | 427 | −23 | +15 |
| 1906 | 428 | 8.63 | Maximum − 1 | 1878 | 414 | −28 | −14 |
| 1911 | 428 | 8.64 | Maximum − 1 | 1892 | 417 | −19 | −11 |
| 1931 | 445 | 8.73 | Maximum − 1 | 1900 | 394 | −31 | −51 |
| 1918 | 463 | 8.74 | Maximum − 1 | 1901 | 430 | −17 | −33 |
| 1920 | 441 | 8.75 | Maximum − 2 | 1905 | 408 | −15 | −33 |
| 1918 | 437 | 8.76 | Maximum − 2 | 1889 | 426 | −29 | −11 |
| 1937 | 429 | 8.76 | Maximum − 2 | 1897 | 404 | −40 | −25 |
| 1918 | 423 | 8.80 | Maximum − 2 | 1879 | 431 | −39 | +8 |
| 1948 | 422 | 8.54 | Maximum − 3 | 1913 | 422 | −35 | 0 |
| 1897 | 411 | 8.54 | Maximum − 3 | 1872 | 426 | −25 | +15 |
| 1923 | 415 | 8.61 | Maximum − 3 | 1901 | 445 | −22 | +30 |
| 1929 | 470 | 8.62 | Maximum − 3 | 1908 | 407 | −21 | −63 |
| 1925 | 409 | 8.57 | Maximum − 4 | 1899 | 398 | −26 | −11 |
| 1913 | 436 | 8.70 | Maximum − 4 | 1866 | 432 | −47 | −4 |
| 1920 | 403 | 8.70 | Maximum − 4 | 1893 | 395 | −27 | −8 |
| 1906 | 413 | 8.71 | Maximum − 4 | 1860 | 428 | −46 | +15 |
| 1936 | 446 | 8.58 | Minimum | 1896 | 416 | −40 | −30 |
| 1879 | 430 | 8.59 | Minimum | 1828 | 449 | −51 | +19 |
| 1927 | 414 | 8.62 | Minimum | 1863 | 410 | −64 | −4 |
| 1923 | 399 | 8.70 | Minimum | 1864 | 392 | −59 | −7 |

For each roll gap setting, the samples were run through the mill in order of increasing gage. The deformation experienced should tend to increase with each sample at a given roll-gap setting. It was clear that the roll-up variable was more important than the sample gage variable in this study. Sixteen of the twentyfour samples experienced reductions in core loss, some of them by more than 10 percent; again demonstrating that the hot deforming concept is a workable and beneficial one.

Metallographic examinations were made on samples before and after the curvature-removing anneal, and virtually no primary grains were observed in the unannealed samples or in the annealed samples. In the absence of domain-refining primary grains, it can be concluded that the deformation grooves themselves, through a magnetostatic effect, caused a domain refinement. The absence of primary grains in Example II was deemed to have been the result of too low a deformation rate at 20 ft/min (6 m/min) feed rate through the rolling mill for the higher temperature employed which resulted in insufficient stored work energy to induce primary recrystallization during the curvature-removing anneal. The loss of temperature after hot deformation may also have contributed to the absence of primary grains.

EXAMPLE III

In this Example, the rolling speed was increased to 85 ft/min (26 m/min) and the flats were machined to a width of 0.07 mm. Once again, the strips were heated to 1650° F. (899° C.), scribed using the helical gear type roll and stress-relief annealed for 4 hours at 1450° F. (788° C.) in an atmosphere of 85% nitrogen-15% hydrogen. However, in this example, 16-strip Epstein packs were prepared instead of single Epstein strips. The results are listed in Table III for samples having a nominal composition as in Example I.

TABLE III

| Pack No. | Condition | Gage (mils) | μ10 | P1.5T (mwppp) | P1.7T (mwppp) |
|---|---|---|---|---|---|
| 584-4I | before | 8.1 | 1891 | 412 | 601 |
| | after treat* | 8.1 | 1890 | 402 | 579 |
| | | | | (−2%) | (−4%) |
| 587-6I | before | 7.8 | 1891 | 448 | 648 |
| | after treat* | 7.8 | 1893 | 428 | 616 |
| | | | | (−4%) | (−5%) |

*treatment = scribed at 85 ft/min at 1300° F. (704° C.), then stress-relief annealed for four hours at 1450° F. (788° C.).

Both of the packs did experience heat-proof domain refinement and primary grains were found to be located beneath some of the scribe lines. The amount of improvement is shown by the percentage change in parentheses. From this it can be concluded that rolling speeds greater than 20 ft/min. should be employed for the higher deformation temperatures.

EXAMPLE IV

Three 16-strip Epstein packs of steel of similar composition as above were rolled using the same roll gap. The amount of deformation each pack received was determined by the gage of steel. The strips from these packs were heated to 1650° F. (898° C.) in air, rolled at 85 ft/min using the helical gear type roll and stress-relief annealed for 4 hours at 1650° F. (898° C.). The results were as follows:

TABLE IV

| Pack No. | Condition | gage (mils) | μ10 | P1.5T (mwpp) | P1.7T (mwpp) |
|---|---|---|---|---|---|
| 567-3I | before | 7.8 | 1897 | 395 | 573 |
| | after treat* | 7.8 | 1875 | 373 | 550 |
| | | | | (−6%) | (−4%) |
| 585-2I | before | 8.0 | 1912 | 458 | 643 |
| | after treat* | 8.0 | 1888 | 380 | 548 |
| | | | | (−17%) | (−15%) |
| 587-50 | before | 8.3 | 1912 | 461 | 635 |
| | after treat* | 8.3 | 1895 | 401 | 571 |
| | | | | (−13%) | (−10%) |

*treatment = scribing at 85 ft/min and 1300° F. (705° C.) then a stress-relief anneal for four hours at 1450° F. (788° C.).

Figure 2A:
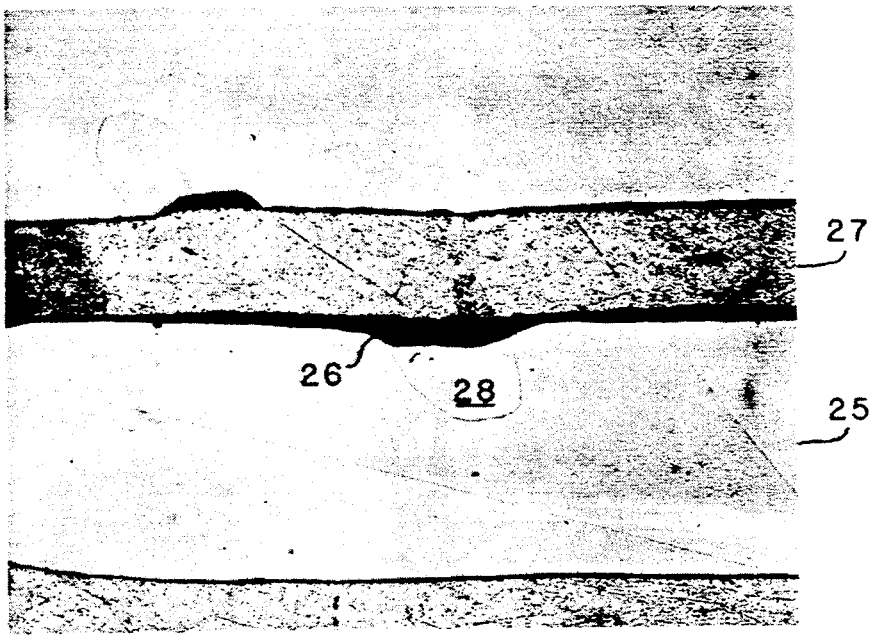
FIGS. 2A–2G comprise photomicrographs at 200 X which illustrate the formation of localized fine recrystallized grains in the vicinity of localized deformations in accordance with the method of the invention.
Figure 2B:
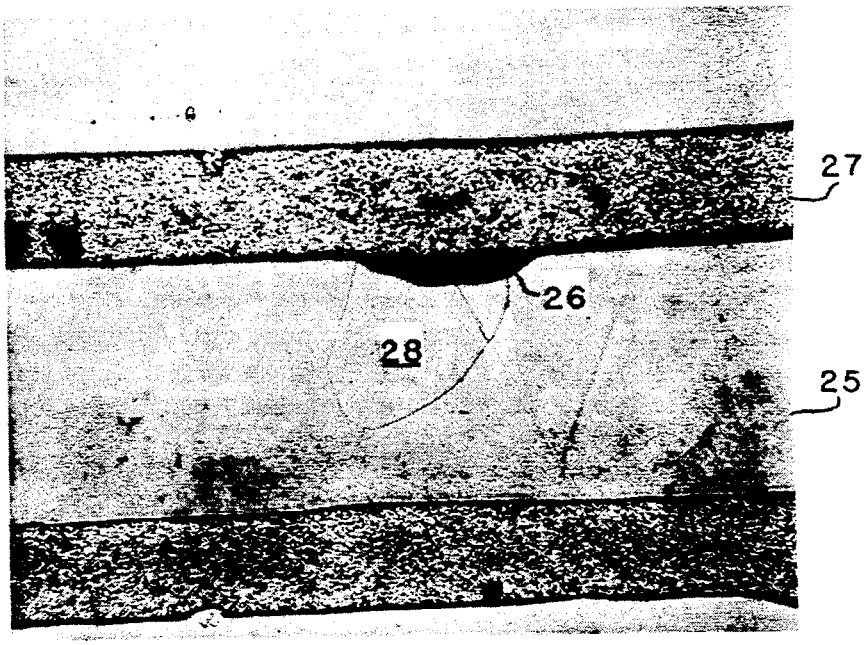
Figure 2C:
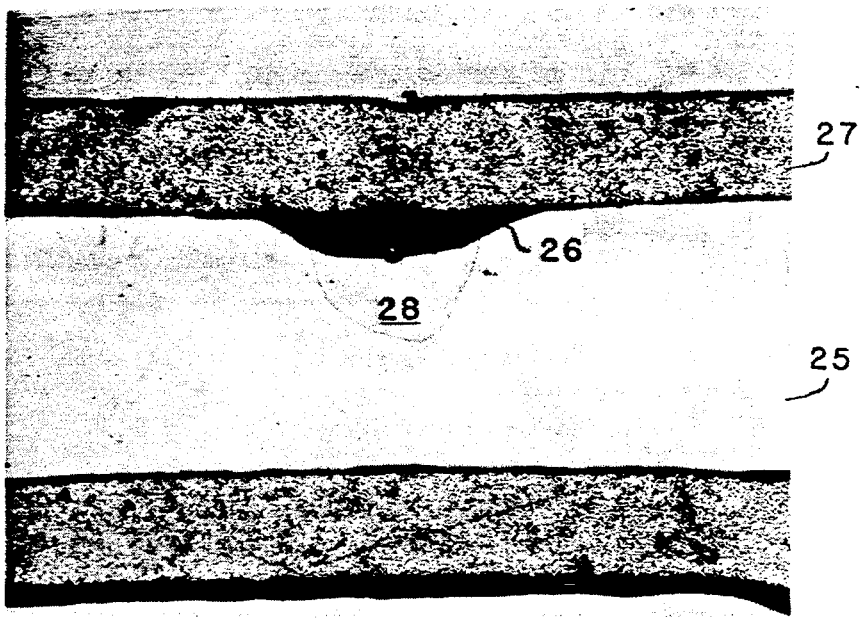

All three packs showed impressive heat resistant domain refinement effects. Primary grains were found beneath most of the scribe lines. This is shown in FIGS. 2A–2C which are edge photomicrographs of Pack Nos. 567-3I, 585-2I, and 587-50, respectively, of Table IV. Reference numerals 25 identify the silicon steel strip and numerals 27 identify copper strips interposed between silicon steel strips in the metallographic pack. The dark areas 26 are those localized areas hot-deformed by the projections 20 on the scribing roll 16 (FIG. 1A). Beneath the hot-deformed grooves of areas 26 are fine localized recrystallized grains 28 which do not grow to a size where the grains extend through the entire thickness of the strip, a condition which is detrimental as will be shown hereinafter. The boundaries of grains 28 have been darkened over those of the original photomicrographs to facilitate ease of illustration. The photomicrographs of FIGS. 2A–2C were taken after a stressrelief anneal and etching using a 3% Nital solution, as were the photomicrographs about to be described.

EXAMPLE V

Based on the foregoing tests (Examples I–IV) efforts were directed toward developing the process on a continuous strip line as in FIG. 1A. A hot-deforming roll with a 10-inch face and a 2.385-inch (60.58 mm) diameter was machined into a helical gear-type roll. This roll had a helical angle of 15°, a gear pitch of 5 mm and flats of 0.076 mm. Two hydraulic air cylinders were used to apply the desired loads to a 5.6 inch wide steel strip. The strip was heated to approximately 1400° F. (760° C.) and entered the roll set at 1200° F.(649° C.). Using a similar highpermeability type of oriented silicon steel as the scribing substrate, a hot deformation run was made. In order to reduce any heat crowning of the anvil roll, it was heated on its edges and air cooled at its center. The hydraulic cylinders were loaded using 8, 10, 13 and 15 psi of air. The line speed was 50 ft/min (15 meters/min) . After the strip was hot deformed in the parallel line pattern, Epstein strips were cut, stress-relief annealed for 4 hours at 1450° F. (788° C.) and then tested. All four of the loads produced strip which showed heat resistant domain refinement effects. When considering the contact area of the roll on the strip, the air pressure in the cylinders and the area of the cylinders, these loads resulted in stresses between 33,000 and 62,500 psi. The data are as follows:

TABLE V

| PACK | SCRIBING STRESS (PSI) | μ10 | P1.5T (mwpp) |
|---|---|---|---|
| Control | 0 | 1883 | 474 |
| A2 | 33,000 | 1849 | 400 |
| | | | (−16%) |
| A3 | 41,600 | 1829 | 419 |
| | | | (−12%) |
| A4 | 62,500 | 1804 | 445 |
| | | | (−6%) |
| A6 | 54,200 | 1812 | 430 |
| | | | (−9%) |
| A7 | 41,600 | 1817 | 438 |
| | | | (−8%) |

Figure 2D:
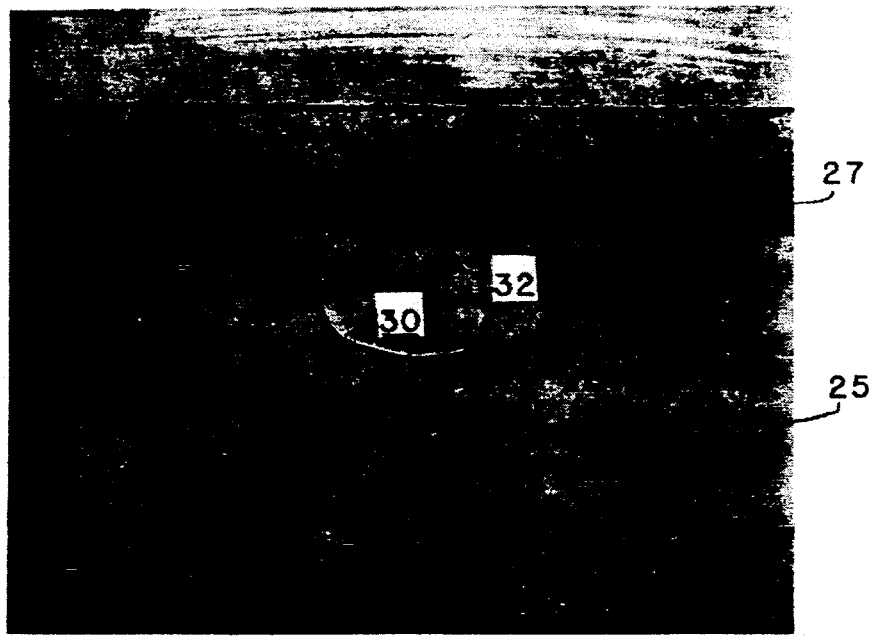
Figure 2E:
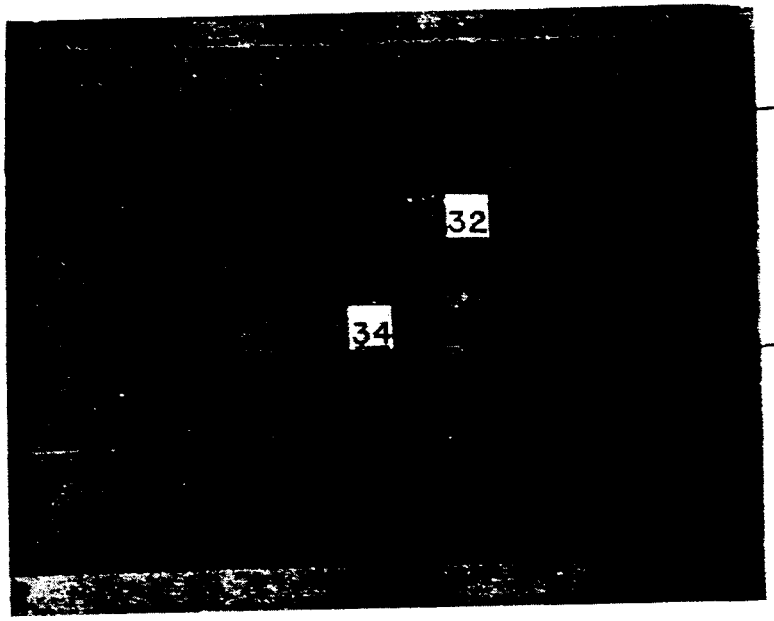
Figure 2F:
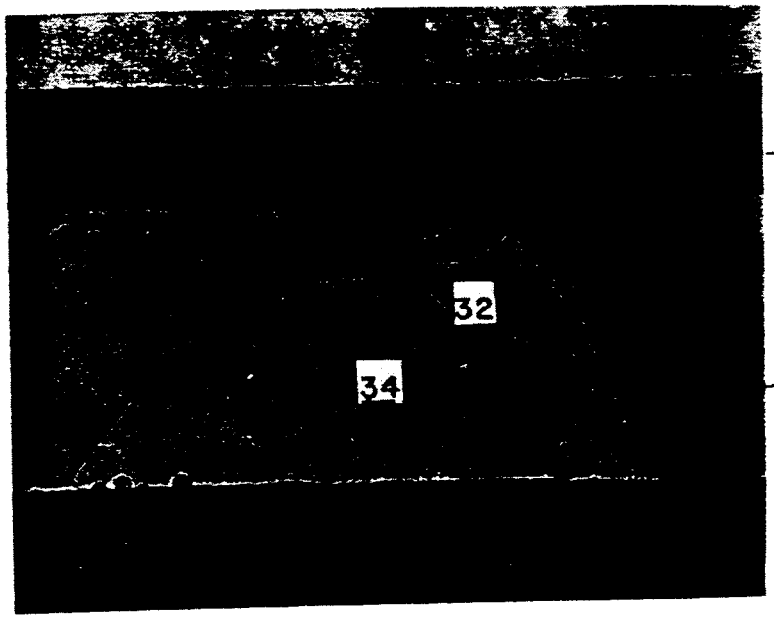

Epstein pack A2 showed very impressive heat resistant domain refinement effects since material from the same mult was mechanically scribed using a stylus and only improved to 395 mwpp. The remainder of the samples appeared to have been deformed too much; however, they all did show heat resistant domain refinement effects. Pack A2 (photomicrograph of FIG. 2D) had primary grains 30 located beneath most of its deformed grooves 32, and most of these grains 30 did not penetrate the thickness of the strip. The other four packs had many primary grains 34 penetrating the strip's thickness as illustrated by photomicrographs (FIGS. 2E and 2F) of samples A3 and A7, respectively.

EXAMPLE VI

Another run was made, with the furnace temperature raised to 1500° F. (815° C.): the line speed was maintained at 50 ft/min. The anvil roll was cooled with water in order to reduce heat crowning. A similar high permeability grain oriented silicon steel with a starting $\mu$10H of 1855 was used in this run. Epstein packs were cut, stress-relief annealed and tested. The results were as follows:

TABLE VI

| SAMPLE | SCRIBING STRESS (PSI) | $\mu$10 | P1.5T (mwpp) |
|---|---|---|---|
| Control (n = 3) | 0 | 1855 | 510 |
| Scribed (n = 9) | 37,125 | 1821 | 453 (−11%) |

*n = number of samples

Figure 2G:
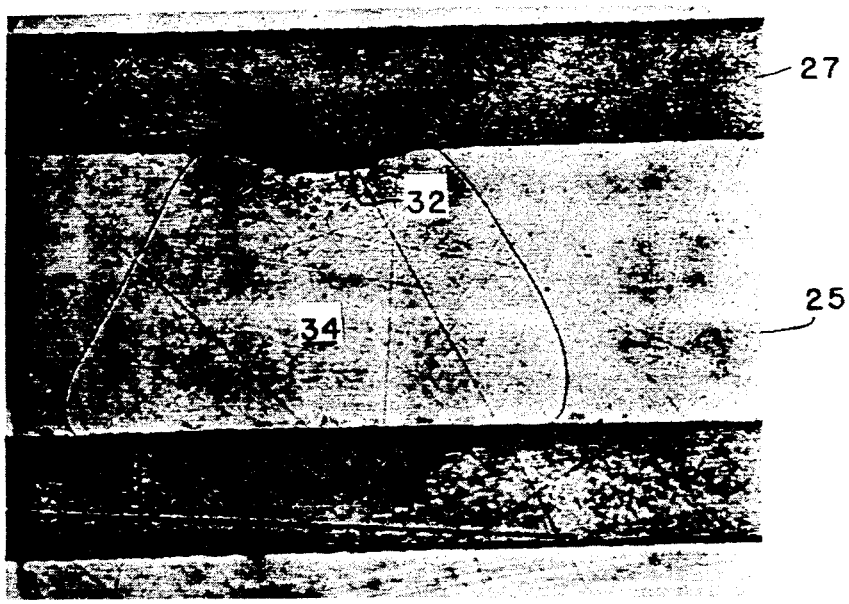

Like the samples above, these packs showed HRDR effects. A photomicrograph of the Control sample is shown in FIG. 2G. Note that the recrystallized grain 34 beneath hot deformed groove 32 extends throughout the entire width of the strip, a result which is undesirable.

From the foregoing examples, it can be seen that rolling speed should be in excess of 20 ft/min (6 meters/min.), preferably greater than 50 ft/min; scribing stress is preferably from 15,000 to 100,000 PSI and not above 120,000 PSI for these roll set up dimensions; and the temperature of the steel during hot deformation should be preferably in the range of 1000° F.–1800° F. (538° to 982° C.) and preferably 1100° F.–1400° F. (593° to 760° C).

Although the invention has been shown in connection with certain specific embodiments, it will be readily apparent to those skilled in the art that various changes in process steps and parameters can be made to suit requirements without departing from the spirit and scope of the invention.

What is claimed is:

1. In combination, means for causing a sheet of final texture annealed grain-oriented silicon steel to be advanced in a given path of travel, means for reheating the sheet while in said path to an elevated temperature above 1000° F. to 1800° F.;

pressure applying means arranged after said heating means in said path for producing on at least one side of the sheet at said elevated temperature during its movement a line pattern substantially transverse to the rolling direction of the sheet of localized deformations; and means for controlling said temperature, speed of deformation and deformation pressure to produce a strain rate sufficient to store energy necessary to facilitate the development of localized fine recrystallized grains in the vicinity of the areas of hot deformation to effect heat resistant domain refinement and reduced core loss.

2. In combination with claim 1, wherein means for producing said line pattern include a scribing roll means and anvil roll means arranged on opposite sides of the sheet in rolling contact with the sheet.

3. In combination with claim 2, wherein said scribing roll means includes a plurality of spaced apart projections thereon extending in a direction substantially parallel to the axis of the roll.

4. In combination with claim 1, after said means for producing a line pattern, means for maintaining the steel at the elevated temperature for sufficient time after deformation to form primary recrystallized grains.

5. In combination, means for causing a sheet of final texture annealed, grain-oriented silicon steel to be advanced in a given path of travel, means for reheating the sheet while in said path to an elevated temperature in the range of 1000° F. to 1800° F., pressure applying means arranged after said heating means in said path for producing on at least one side of the sheet at said elevated temperature during its movement a line pattern substantially transverse to the rolling direction of the sheet of localized deformations at a strain rate sufficient to store energy necessary to facilitate the development of localized fine recrystallized grains in the vicinity of the areas of hot deformation of effect heat resistant domain refinement and reduced core loss, said means for producing said line pattern include a scribing roll means and anvil roll means arranged on opposite sides of the sheet in rolling contact with the sheet, said scribing roll means includes a plurality of spaced apart projections thereon extending in a direction substantially parallel to the axis of the roll, means for controlling said temperature, speed of deformation and deformation pressure to produce said strain rate sufficient to store energy in the sheet necessary to facilitate development of localized fine recrystallized grains, and after said means for producing a line pattern, means for maintaining the steel at the elevated temperature for sufficient time after deformation to form primary recrystallized grains.

* * * * *